United States Patent [19]

Vonhausen et al.

[11] Patent Number: 4,612,863

[45] Date of Patent: Sep. 23, 1986

[54] WORK TABLE

[75] Inventors: Robert Vonhausen, Giessen-Wieseck; Rainer Machate, Biebertal, both of Fed. Rep. of Germany

[73] Assignee: VOKO Franz Vogt & Co., Pohlheim, Fed. Rep. of Germany

[21] Appl. No.: 543,186

[22] Filed: Oct. 18, 1983

[30] Foreign Application Priority Data

Oct. 23, 1982 [DE] Fed. Rep. of Germany ..... 3239371

[51] Int. Cl.[4] ..... A47B 17/00; B25H 1/02

[52] U.S. Cl. ..... 108/28; 108/50; 108/97; 144/286 R

[58] Field of Search ..... 108/28, 50, 97, 140; 144/286 R, 287; 269/76; 312/223

[56] References Cited

U.S. PATENT DOCUMENTS

| | | | |
|---|---|---|---|
| 1,516,489 | 11/1924 | Barton | 24/525 X |
| 3,140,559 | 7/1964 | Grow et al. | 108/6 |
| 3,471,629 | 10/1969 | O'Leary | 174/97 |
| 3,635,174 | 1/1972 | Ball et al. | 108/50 X |
| 4,043,626 | 8/1977 | Propst et al. | 174/101 |
| 4,190,002 | 2/1980 | Redemann | 108/50 |
| 4,296,981 | 10/1981 | Hildebrandt et al. | 312/223 X |
| 4,323,291 | 4/1982 | Ball | 312/223 X |

FOREIGN PATENT DOCUMENTS

| | | | |
|---|---|---|---|
| 6707 | 1/1980 | European Pat. Off. | 108/50 |
| 10277 | 4/1980 | European Pat. Off. | 108/50 |
| 28763 | 9/1884 | Fed. Rep. of Germany | 108/50 |
| 551850 | 7/1974 | Switzerland | 108/28 |
| 614112 | 11/1979 | Switzerland | 108/28 |
| 804420 | 2/1981 | U.S.S.R. | 144/287 |

*Primary Examiner*—William E. Lyddane
*Assistant Examiner*—Peter R. Brown
*Attorney, Agent, or Firm*—Flynn, Thiel, Boutell & Tanis

[57] ABSTRACT

A work table having a pedestal and a table top supported on the pedestal and adapted to support organizational walls, shelves, electrical devices, computers, and telephones, without limiting the work surface of the table or requiring that the work table be placed on a wall. The work table has in a rear region and below the table top a multifunction rail which extends the entire width of the table and is fixedly supported on the pedestal of the table. The multifunction rail is freely accessible from the rear of the table and can support devices which in turn support visible and organizational walls, shelves for additional items, files, lights, and so forth.

1 Claim, 6 Drawing Figures

WORK TABLE

FIELD OF THE INVENTION

This invention relates to a work table having a pedestal and a table top supported on the pedestal.

BACKGROUND OF THE INVENTION

In modern offices, electrical devices such as computers are being increasingly utilized and must be arranged near the work table of the operator. As a rule, these devices are placed on the work table, namely the desk, so that the operator has direct and easy access thereto. These additional devices, just like telephones, lamps, shelves, etc., considerably limit the available working space on the table, so that other uses of the table are substantially influenced.

If, with conventional work tables, an organization wall is to be arranged behind the table, then either the work table must be arranged directly on the wall or a separate wall is needed and is set up behind the work table. The work table can not always be placed on a wall, and the need for an additional wall behind the table considerably influences the remaining room design and is also expensive.

A basic purpose of the invention is to provide a work table of the above-mentioned type which can be equipped with any desired organization arrangement, electrical devices, computers, telephones, shelves, etc. which all lie within the working range of the operator, but without the working surface of the table being limited by the additional organization arrangement and devices, and without placing the table on a wall when organization walls are needed.

SUMMARY OF THE INVENTION

This purpose is attained inventively by providing in the rear of the table and below the table top a multifunction rail which extends the entire width of the table and is fixedly secured to the pedestal of the table. The multifunction rail is freely accessible from the rear of the table and is constructed for fastening thereon devices for supporting see-through and organization walls, shelves for additional devices, files, lamps, etc.

Thus, the multifunction rail is used to arrange additional devices on the table. For example, an organization wall can be arranged on the multifunction rail, or the rail can support shelves which can be swung over the desk and on which the additional devices are arranged. Furthermore, it is also possible to support lighting devices on the multifunction rail. The desk surface is thus available for other activities, regardless of the additional devices.

According to a further feature of the invention, the multifunction rail is hollow, so that it can receive wires or other lines. These can be electrical supply lines, telephone lines, or even air-conditioning lines. Furthermore, since the multifunction rail is fixedly secured to the pedestal of the table, if the pedestal is hollow the lines can be guided directly into the multifunction rail through the pedestal. Furthermore, the multifunction rail can also be used in order to connect and carry lines to tables which are side by side or which form an angle with respect to one another.

The multifunction rail advantageously includes two U-shaped elements which are spaced from one another, the fastening devices for the accessories including two clamping jaws which grip one U-shaped element and are clamped against it. Thus, it is possible to support an additional device at any desired point along the multifunction rail.

BRIEF DESCRIPTION OF THE DRAWINGS

One exemplary embodiment will be described in greater detail hereinafter in connection with the drawings, in which.

DETAILED DESCRIPTION

Figure 1:
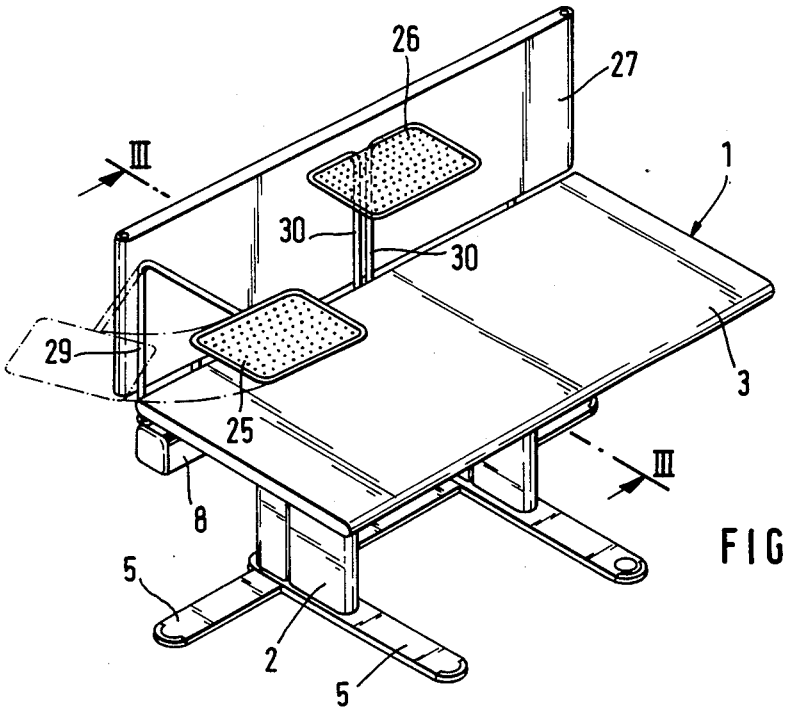
FIG. 1 is a perspective view of a work table embodying the invention in a normal position.
Figure 3:
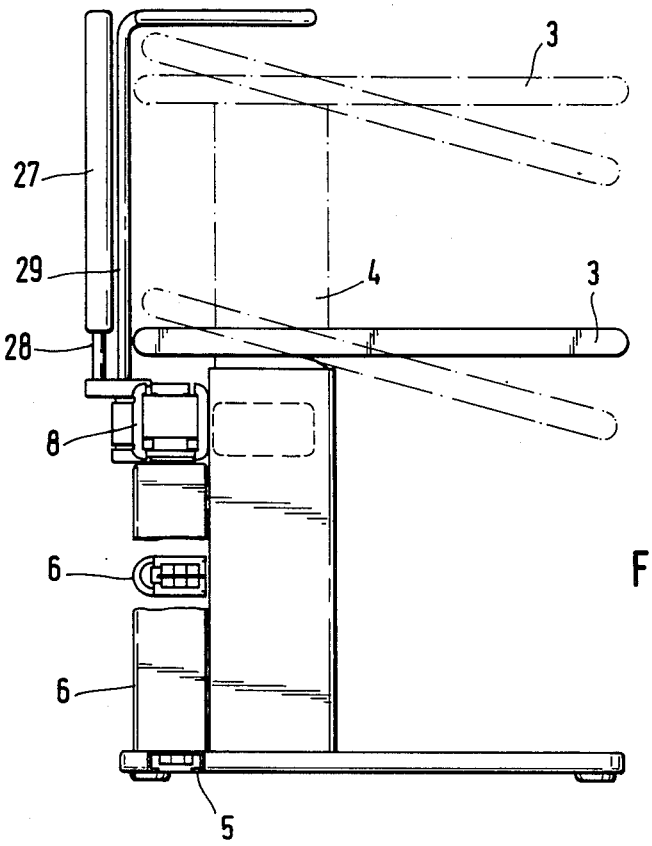
FIG. 3 is a side view of the table of FIG. 1.
Figure 4:
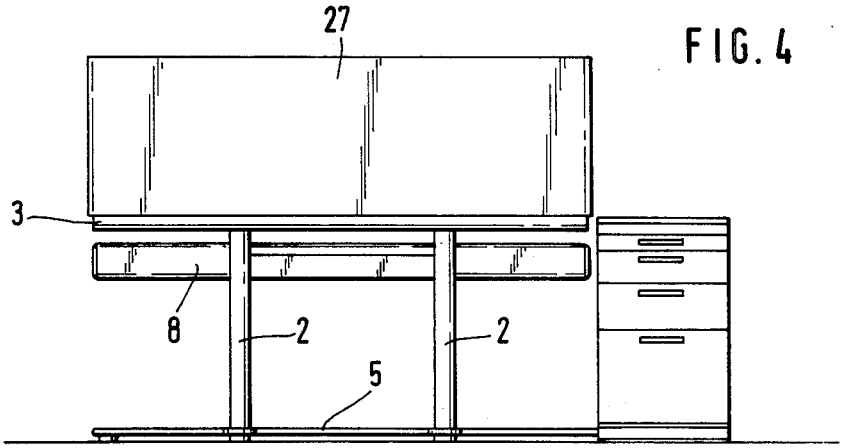
FIG. 4 is a front view of the table of FIG. 1.

The work table 1 which is illustrated in FIG. 1 has a pedestal 2 on which a table top 3 is vertically movably supported. The table top 3 has two downwardly projecting lifting columns 4 which are movably supported in the pedestal. The pedestal in turn has feet 5 which extend the depth and the width of the work table 1. The feet 5 are hollow, as shown in FIG. 3, so that they can receive wires or other lines (not illustrated) which come out of the floor. These lines extend up through the laterally spaced rear parts 6 of the pedestal. The rear parts 6 are also hollow. The pedestal is reinforced below the table top by a reinforcing element 7.

Figure 5:
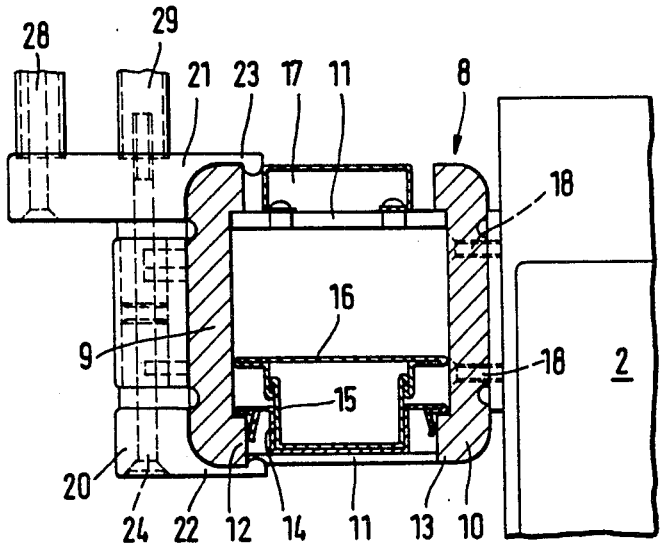
FIG. 5 is a sectional view taken along the line V—V of FIG. 2.

Furthermore, a multifunction rail 8 is mounted on the rear of the pedestal above the parts 6 thereof, which multifunction rail 8 contributes further to the reinforcement of the pedestal. The construction of the multifunction rail 8 can best be seen from FIGS. 3 and 5. The multifunction rail 8 consists of two U-shaped elements 9 and 10 which are spaced from one another. The connection of these two elements 9 and 10 is effected by bolts 11 which are provided in the upper and lower regions thereof. It is sufficient if the bolts 11 are arranged near the ends of the U-shaped elements so that the region of the rail which lies therebetween can be freely utilized.

A U-shaped rail 14 is placed on the lower legs 12 and 13 of the two U-shaped elements and defines a bottom wall of the multifunction rail 8. The rail 14 has openings at the points where the pedestal engages the multifunction rail 8. Furthermore, a further U-shaped rail 15 is provided in the multifunction rail and can if desired be closed by a lid 16. Through this, separate spaces are created in the multifunction rail 8 which are suitable for receiving different types of wires or lines. The upper region of the multifunction rail is partially closed by a lid 17 which is supported at its ends on the bolts 11, the lid 17 being spaced a small distance from the end of the upper leg on each of the elements 9 and 10. The fastening of the multifunction rail 8 to the pedestal 2 is effected by means of screws 18. The ends of the multifunction rail 8 can be aligned with and connected to the ends of similar rails on adjacent tables or, in the case of a stand-alone table as shown in FIGS. 1 and 2, can be closed by cover caps 19.

The fastening device for attaching accessories on the rail 8 includes two vertically spaced clamping jaws 20,21 which have extensions 22,23 which grip around the U-shaped element 9. The two clamping jaws 20,21 are pressed toward each other by a screw 24 which cooperates with them so that the extensions 22,23 are firmly pressed against the U-shaped element 9. Through this, a form-locking connection between the clamping jaw and the U-shaped element 9 is obtained, so that additional devices which are supported on the upper clamping jaw 21 are held securely and safely. The clamping jaw 21 is larger than the clamping jaw 22 and serves to support devices such as shelves 25,26 or an organization wall 27, which are illustrated in FIG. 1. The organization wall 27 is supported by two columns 28 on respective clamping devices on the multifunction rail 8, while the shelf 25 is supported on the multifunction rail 8 by only one column 29. However, it is also conceivable, where heavy items will be put on the shelf 25, to support the shelf 25 with two columns 30 on the multifunction rail 8.

Figure 2:
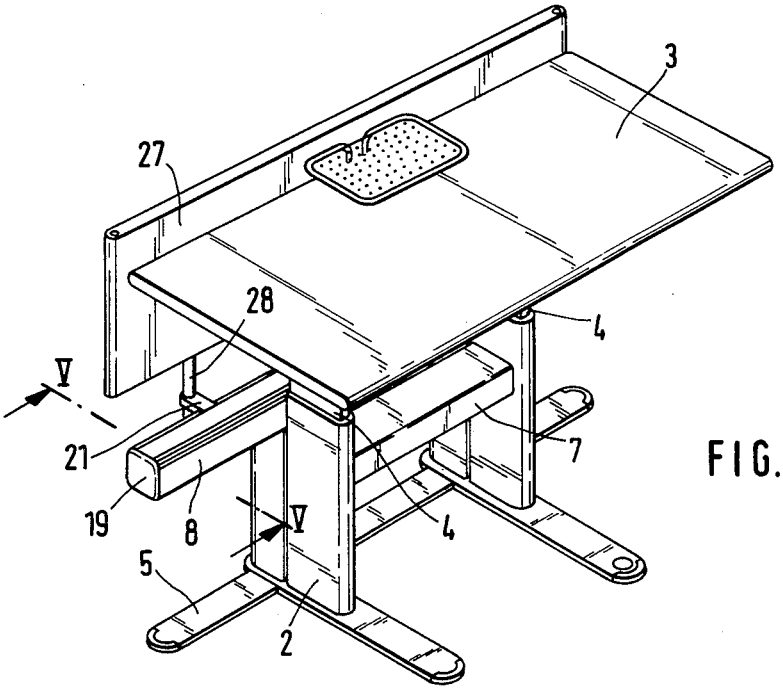
FIG. 2 is a perspective view similar to FIG. 1 but illustrating the work table of FIG. 1 with its table top in a lifted position.

The illustrated table advantageously has a vertically movable table top 3, as this can be seen from FIGS. 1 to 3. Through this, one achieves the advantage that the work table is suited for use when standing and when sitting. It is furthermore advantageous for the table top 3 to be pivotally supported. This type of support of the table top 3 on the pedestal 2 furthermore brings about the advantage that the multifunction rail 8 is freely accessible when the table top 3 is lifted.

The pivotal support of the table top 3 on the columns 4 and the mechanisms which releasably secure the columns 4 in a selected vertical position and releasably secure the table top 3 in a selected pivotal position are conventional and therefore not illustrated or described in detail.

Figure 6:
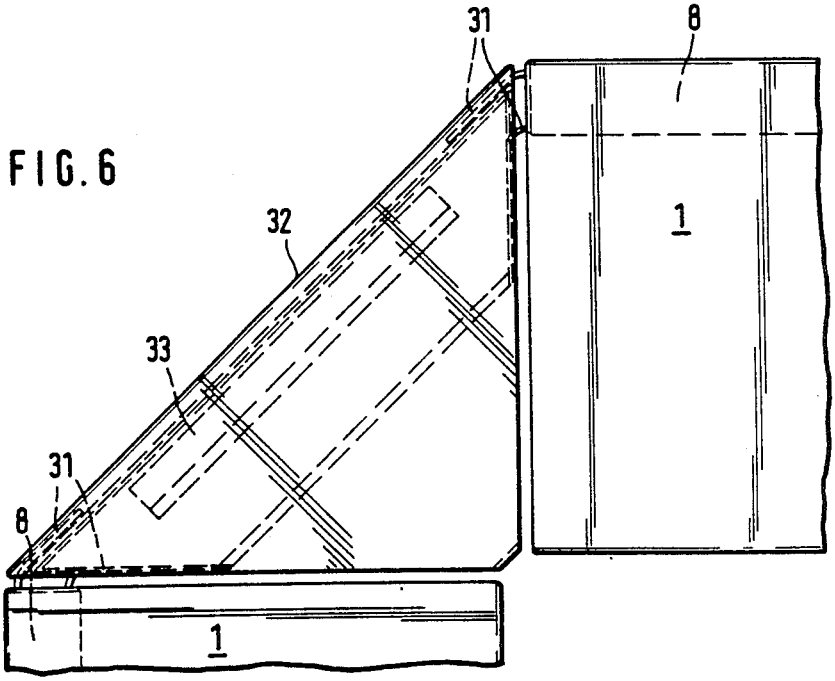
FIG. 6 is a top view of a corner element which connects two tables of the type depicted in FIGS. 1 to 5.

FIG. 6 illustrates the connection of two tables 1 by a triangularly shaped corner element. For this, fastening plates 31 are inserted into the multifunction rails 8 and are connected to and support the corner element 32. The corner element 32 has a multifunction rail which is also hollow, and it is possible to provide partitions 33 to separate different wires or lines.

Thus, the inventive work table permits a full use of the table top even when using additional devices, since these devices can be placed on the shelves which are supported on the multifunction rail 8. Further, the capability of lifting, lowering and tilting the table top assures easy accessibility to the multifunction rail 8, so that fastening supports thereon for additional devices is easy. Moreover, the multifunction rail also permits the support of see-through and organization walls which can be arranged in a second plane disposed behind the plane of the supports for the shelves, so that such walls can be mounted on spaced work tables without a need for additional and independent walls or partitions to be installed.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a work table which includes a pedestal, a table top supported on said pedestal, and a rail which is disposed below said table top in a rear region of said table, which extends the entire width of said table, which is connected fixedly to said pedestal, and which is freely accessible, the improvement comprising wherein said rail is a multi-function rail which is hollow, the interior of said multi-function rail being accessible by means of a lid which is removably supported in an opening in said multi-function rail, wherein said multi-function rail has ends which are freely accessible and are adapted to receive fastening plates which can connect said multi-function rail to at least one of an attachment and a further rail; wherein said multi-function rail includes means for dividing the interior thereof into several separate regions which each extend lengthwise thereof; wherein said pedestal includes means for vertically movably supporting said table top, said multi-function rail being fixedly connected to a portion of said pedestal which is stationary, and includes means supporting said table top for pivotal movement about a substantially horizontal axis; wherein at least one portion of said pedestal is hollow; wherein said multi-function rail includes two U-shaped profiles which are spaced and which each have legs which each project toward a leg on the other U-shaped profile, said U-shaped profiles being connected to one another by means which includes bolts extending therebetween; including fastening means for supporting an accessory part on said multi-function rail, said fastening means including two clamping jaws which can be positionally adjusted relative to one another and can securely grip one of said U-shaped profiles; including two supports which are mounted on said fastening means and which each support a respective accessory part; and wherein said supports are spaced rearwardly from a rear edge of said table top by different distances.

* * * * *